US009101531B1

(12) United States Patent
Song

(10) Patent No.: US 9,101,531 B1
(45) **Date of Patent: *Aug. 11, 2015**

(54) LOCKED PILL BOTTLE WITH TIMED DISPENSE LIMITS

(71) Applicant: Michael Song, Old Tappan, NJ (US)

(72) Inventor: Michael Song, Old Tappan, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/565,537

(22) Filed: Dec. 10, 2014

Related U.S. Application Data

(63) Continuation of application No. 13/761,319, filed on Feb. 7, 2013, now Pat. No. 8,936,175.

(51) Int. Cl.
*B65D 83/04* (2006.01)
*A61J 7/04* (2006.01)

(52) U.S. Cl.
CPC ..... *A61J 7/0481* (2013.01); *B65D 83/0409* (2013.01)

(58) Field of Classification Search
CPC ..... B65D 83/04
USPC ..... 221/2, 15, 276, 267, 268
See application file for complete search history.

(56) References Cited

U.S. PATENT DOCUMENTS 1,974,332 A * 9/1934 Hauck ..... 221/281
3,129,845 A * 4/1964 Musser ..... 222/41
3,410,452 A * 11/1968 Igel et al. ..... 221/13
3,593,881 A * 7/1971 Paap ..... 221/3
3,833,147 A * 9/1974 Borsum et al. ..... 221/202
4,405,060 A * 9/1983 Hsei ..... 221/135
4,415,098 A * 11/1983 Haas ..... 221/202
4,648,529 A * 3/1987 Blakemore et al. ..... 221/1
6,189,731 B1 * 2/2001 Schmitt ..... 221/103
6,726,058 B2 * 4/2004 Giraud ..... 221/267
7,108,153 B2 * 9/2006 Wood ..... 221/15
2007/0228065 A1 * 10/2007 Anderson et al. ..... 221/152
2013/0116818 A1 * 5/2013 Hamilton ..... 700/236

* cited by examiner

*Primary Examiner* — Patrick Mackey
(74) *Attorney, Agent, or Firm* — Michael J. Feigin, Esq.; Feigin & Associates, LLC

(57) ABSTRACT

The disclosed pill bottle allows for timed dispensing of medicine, as programmed by a doctor, pharmacist, or caregiver. The device has a slot for pill entry in any one of the walls, the slot being sealable and lockable. In an unlocked and open condition, the slot is a portal from the outside of the bottle into an inner cavity, the cavity being adapted for pill storage and extending between the slot/opening for pill entry and an exit tube. The exit tube is sized for single-file passage of a plurality of pills. A spring-loaded member is adapted to apply pressure in the exit tube on a single pill of the plurality of pills such that the pressure prevents exit of the single pill and the single pill blocks other pills of the plurality of pills from exiting. A button extends through a wall, such as the side wall, and is configured to release the pressure (defined as changing the static nature of the pill and spring placement) on the single pill, allowing it to fall.

12 Claims, 12 Drawing Sheets

LOCKED PILL BOTTLE WITH TIMED DISPENSE LIMITS

FIELD OF THE DISCLOSED TECHNOLOGY

The disclosed technology relates generally to pill bottles and, more specifically, to locked pill bottles with limits on pill dispensing.

BACKGROUND OF THE DISCLOSED TECHNOLOGY

Most people take medicine only for the conditions for which their doctors prescribed them. However, an estimated 20% percent of people in the United States have used prescription drugs for non-medical reasons, according to the National Institute for Health. Prescription drug abuse is a serious and growing problem, often leading to addiction to narcotics, sedatives, and stimulants.

In order to prevent abuse of narcotics, prior art has been developed in the form of lockable pill bottles and time release pill bottles. Lockable pill systems are often prone to tampering, and require very different structures than people are used to using, creating a barrier to entry. One example of a lockable pill device is disclosed in U.S. Pat. No. 6,401,991 to Eannone disclosing a computer-timed and locked medication container. This device has a plurality of compartments, and at an appropriate time, a next compartment is opened, allowing release of medicine.

What is required in the art is a secure method of storing and dispensing pills, that an end-user may use, without being supervised by a third party. Still further, a method of dispensing pills in a way which prevents abuse is needed.

SUMMARY OF THE DISCLOSED TECHNOLOGY

An embodiment of the disclosed technology is a lockable pill bottle for a plurality of pills. While "pill," in the singular is used, it should be understood that a dosage of pills may include a single pill or a plurality of pills. A device used has a bottom wall, side wall, and top wall. The device has a slot for pill entry in any one of the walls, the slot being sealable and lockable. In an unlocked and open condition, the slot is a portal from the outside of the bottle into an inner cavity, the cavity being adapted for pill storage and extending between the slot/opening for pill entry and an exit tube. The exit tube is sized for single-file passage of a plurality of pills. A spring-loaded member is adapted to apply pressure in the exit tube on a single pill of the plurality of pills, such that the pressure prevents exit of the single pill, and the single pill blocks other pills of the plurality of pills from exiting. A button extends through a wall, such as the side wall, and is configured to release the pressure (defined as changing the static nature of the pill and spring placement) on the single pill, allowing it to fall.

A timing device is used in embodiments of the disclosed technology, enabling release of a pill of the plurality of pills only at specified times. The timing device may allow release of a pill by removing a blocking bar from an exit tube, the blocking bar situated below the spring-loaded member, where a bottom of the device is defined as closest to a side where pills exit the exit tube, or the direction in which the bottle must be oriented in order for the pills to exit the exit tube Removing the blocking bar may release a pill of the plurality of pills, this pill being below the spring-loaded member, while the spring-loaded member simultaneously retains another pill in place.

In other embodiments, the timer may cause release of a pill held beneath the pill held by pressure of the spring-loaded member at automatic timed intervals. In such an embodiment, pressing the button may cause a pill to be released from the spring-loaded member if a space in the exit tube below the button and above a blocking bar, blocking passage of a pill in said exit tube, lacks a pill therein. That is, a pill (or pills) is released at automatic intervals, as long as before the next pill is released, the previous one has been taken from the pill bottle by press of the button extending through the side wall of the device.

In yet other embodiments of the lockable pill bottle, during intervals of time, the timer causes the button extending through the wall to be non-functional by preventing its movement, or disengaging the spring-loaded member from the button. This may be accomplished mechanically or by disabling an electric component required to operate the button.

In a variation of any of the above embodiments, the timer enables release of the pill by allowing rotation of a blocking bar. Using the button, the blocking bar becomes positioned in-line with the exit tube, allowing a pill to pass through the blocking bar and exit tube to a release area.

In another embodiment, the spring-loaded member has two springs in-line with each other, a first stronger and more rigid spring closer to the button, and a second weaker and less rigid spring closer to the exit tube. When used in this disclosure, "stronger" and "weaker" is in comparison to the strength of the other described spring and refers to the resistance level when compressing the respective springs from their resting position to 50% compression.

In another embodiment, the spring-loaded member is on an opposite side of a pill housing, compared to the button. That is, in line, there is a button, pill housing, then spring. In this embodiment, the pill housing has an inner space adapted to fit a single pill of the plurality of pills, a top opening adapted to accept a pill into the housing from the exit tube, when—and only when—the housing lacks a pill therein, and a bottom opening adapted to drop a pill into a release area. When the button is pushed in a direction of a wall (through which the button is attached) of the bottle, the spring-loaded member is compressed, and the pill housing moves with the button towards the spring. A flange blocks entry of another pill into the pill housing while the button is being pushed/spring is compressed, and a pill in the housing exits to the release area.

In a method of the disclosed technology, a pill dispenser is configured by placing pills into an opening which opens into a cavity of the pill bottle. The pill bottle has a lower wall, side walls, and top wall. The opening is then closed and locked, and designated time intervals are configured, so that the pill bottle allows dispensing of pills, only at those intervals of time. Dispensing of pills is defined as allowing a pill to exit to a release area where a user may obtain the pill at any time the user wishes, or releasing the pill from the bottle when the user presses a button indicating that a pill should be released. When the pill bottle allows dispensing of pills, at the designated time, a spring-loaded button is depressable to remove pressure on a pill in an exit tube, allowing the pill to drop from the exit tube, the exit tube opening into the cavity and a pill receiving area, the pill receiving area open to an outside of said pill bottle.

Embodiments described with reference to the device of the disclosed technology are equally applicable to methods of use thereof.

DETAILED DESCRIPTION OF EMBODIMENTS OF THE DISCLOSED TECHNOLOGY

The disclosed pill bottle allows for timed dispensing of medicine, as programmed by a doctor, pharmacist, or caregiver. The device has a slot for pill entry in any one of the walls, the slot being sealable and lockable. In an unlocked and open condition, the slot is a portal from the outside of the bottle into an inner cavity, the cavity being adapted for pill storage and extending between the slot/opening for pill entry and an exit tube. The exit tube is sized for single-file passage of a plurality of pills. A spring-loaded member is adapted to apply pressure in the exit tube on a single pill of the plurality of pills, such that the pressure prevents exit of the single pill and the single pill blocks other pills of the plurality of pills from exiting. A button extends through a wall, such as the side wall, and is configured to release the pressure (defined as changing the static nature of the pill and spring placement) on the single pill, allowing it to fall.

Embodiments of the disclosed technology will become clearer in view of the following description of the drawings.

Figure 1:
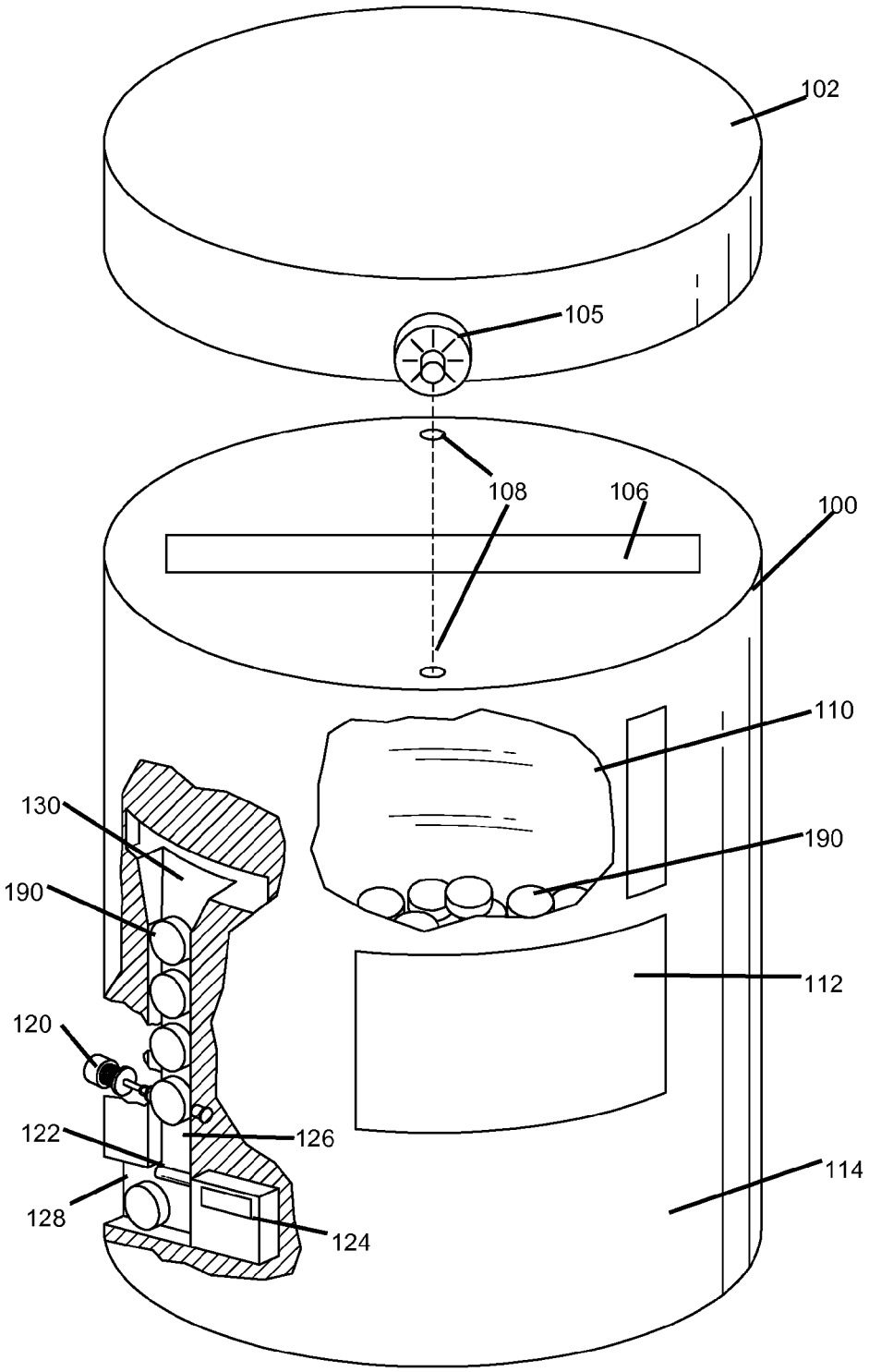
FIG. 1 shows a lockable pill bottle with dose-release mechanism of an embodiment of the disclosed technology.

FIG. 1 shows a lockable pill bottle with dose-release mechanism of an embodiment of the disclosed technology. Pills 190 are placed into a container 100 by way of an entry slot 106 or other opening, which opens into a cavity 110. A lid 102 is then secured onto the bottle 100 by way of a lock 105 which locks the lid 102 onto the bottle 100 with pegs or other projections which lodge in the receptacles 108. The lid 102 becomes locked onto the bottle 100 by way of the lock 105 and peg receptacles 108, which may be 1, 2, 3, 4, or 8 receptacles. Any locking mechanism known in the art may be used, including L-shaped pegs rotating into receptacles, pins which expand when extended, and so forth.

On the bottle 100, there are labels 112, in embodiments of the disclosed technology, with information about the medication and timing for which it may be taken (how often a gate will open, allowing a pill to be taken). The bottle shown here has a cylindrical housing 114 with a bottom side, side walls, and top side. The cavity 110 lies therein with pills 190 which exit into an exit chamber 130. The pills 190 exit into this exit chamber by way of gravity and/or tiling the bottle, so that pills in the chamber 110 may exit into the exit chamber 130.

Figure 2:
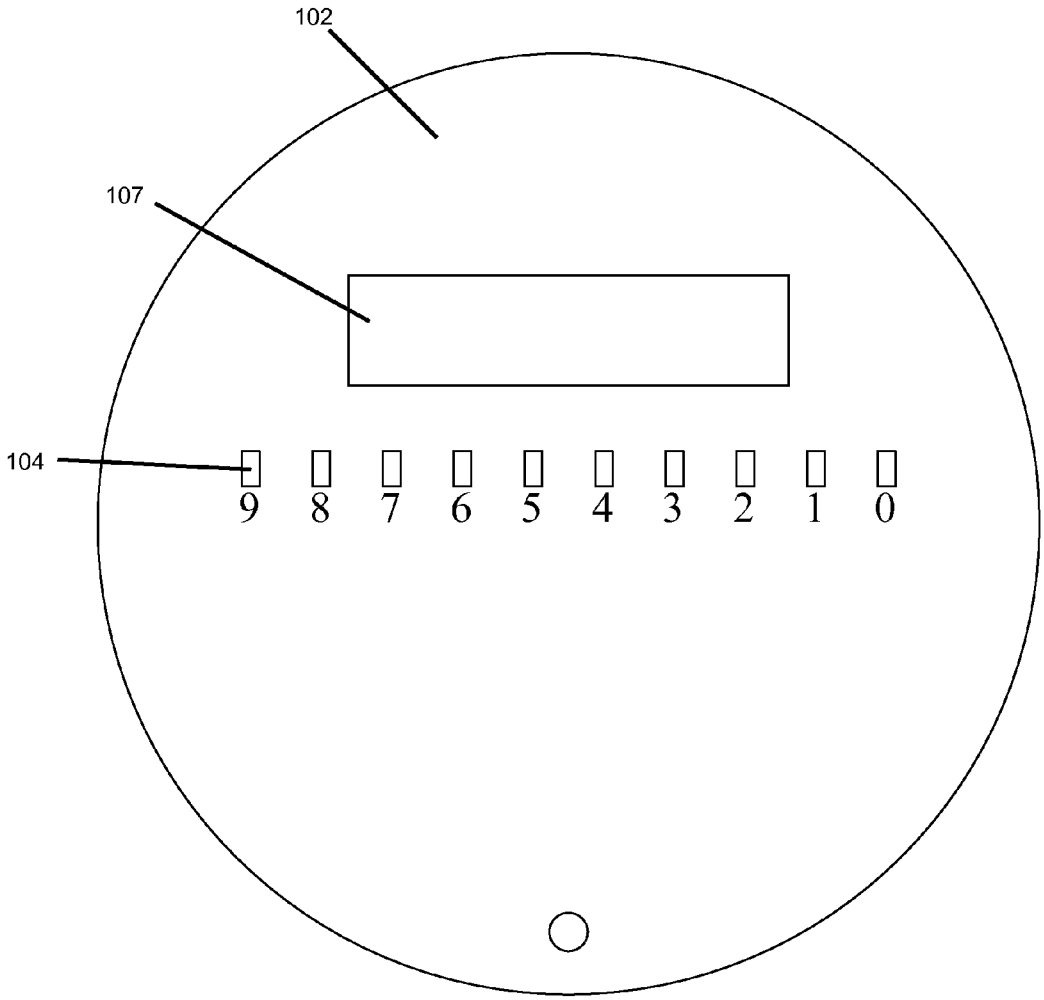
FIG. 2 shows a top view of a lid of a pill bottle of embodiments of the disclosed technology.

FIG. 2 shows a top view of a lid of a pill bottle of embodiments of the disclosed technology. Here, the lid 102 has a label 107, which may be a window into the cavity 107 so the user can see how many pills are left, and buttons and/or indicators 104 indicating the time until the next pill or pills should be taken, to be reset at either regular time intervals, after a pill is taken out, or a combination thereof ensuring that a user cannot overdose on pills.

Referring back to FIG. 1, and specifically, the exit chute 130 and associated elements connected thereto, the exit chute 130 allows for pills from the larger cavity 110 to exit from the device, after passing through security mechanisms. The pills 190 exit or fit through the chute in single file. They are blocked by pressure against a single pill at button 120. (This section is shown in greater detail in FIGS. 3 and 6.) A blocking bar 122 prevents the dropping of a bill into a removal area 128, which opens to the outside. This blocking bar is mechanically or electrically (such as via a solenoid) controlled by electronics or mechanics in housing 124 into which the bar retracts. The electronics, of course, may be anywhere within the device 100. As such, when the time comes to drop a pill, it may be dropped by a person using button 120 or automatically; the blocking bar 122 opens, and the pill may exit into the removal area 128. The combination of the button 120 and blocking bar 122 allows a user to have control, or feel in control, over the dispensing of medication. When the time arrives for taking the next pill (or pills), the blocking bar opens allowing passage of a pill when a button is pressed. In other embodiments, the blocking bar 126 only opens upon pressing of the button 120 when the time has arrived for dispensing of a pill. When the user presses button 120, it allows a single pill 190 to fall into the space below the pressed pill, just above the blocking bar, and the blocking bar 122 opens in due course, allowing the pill to escape the housing into the removal area 128, where the device may be tilted to retrieve the pill.

Figure 3:
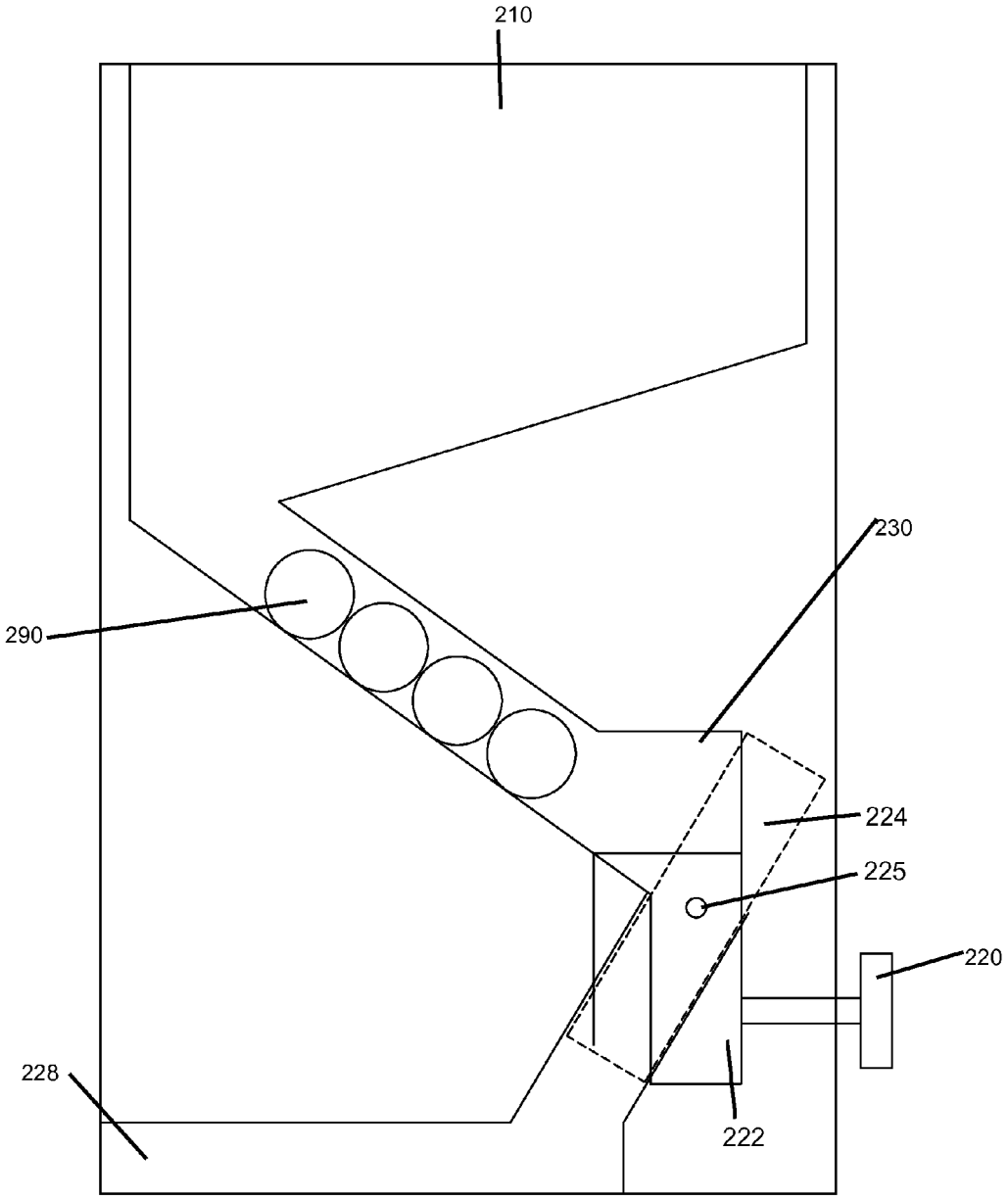
FIG. 3 shows a cross-section of a housing of a pill bottle with pills in embodiments of the disclosed technology.

FIG. 3 shows a cross-section of a housing of a pill bottle with pills, in embodiments of the disclosed technology. The pill bottle shown is a variation of the one shown in FIG. 1; however, the similar elements have been incremented by 100. Thus, the cavity 210 has an exit tube 230 where the pills 290 exit. A button 220 is used to rotate a blocking member 222 about an axle 225, such that a tube with hollow opening for pills to fit through when the blocking member 222 is in the dotted line space designated as 224 aligned with the exit tube at a position horizontal the button 220. When in this second position, where the body of the blocking member 222 below the axle 225 is aligned with the exit tube, pills may pass through. Again, the ability to rotate the blocking member 222 may be time controlled. That is, when it is not time to take a pill, the axle 225 or button 220 is locked. When unlocked, after a pill or a number of pills pass through for a dose (detected by a sensor in the blocking bar 222 or another blocking bar above or below the bar 222), the blocking bar 222 again returns to a closed position where pills 290 cannot pass. In the removal area 228, pills can be removed.

Figure 4:
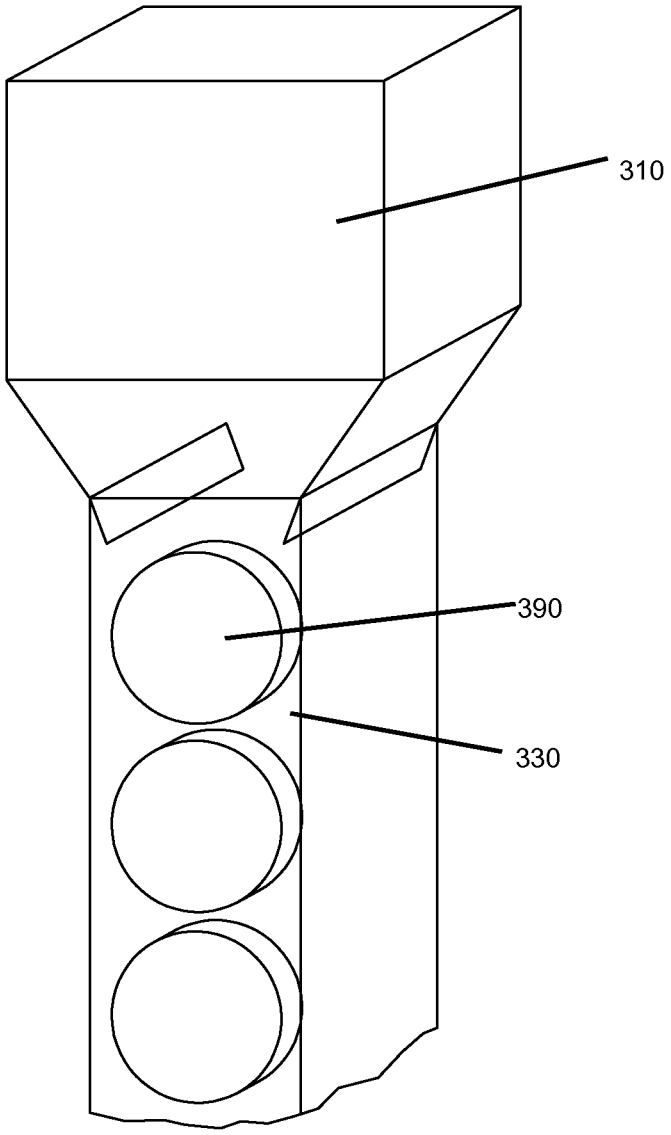
FIG. 4 shows a close-up of an exit tube used in embodiments of the disclosed technology.

FIG. 4 shows a closeup of an exit tube used in embodiments of the disclosed technology. A cavity 310 stores a plurality of pills, and the pills exit, single file, into an exit tube 330.

Figure 5:
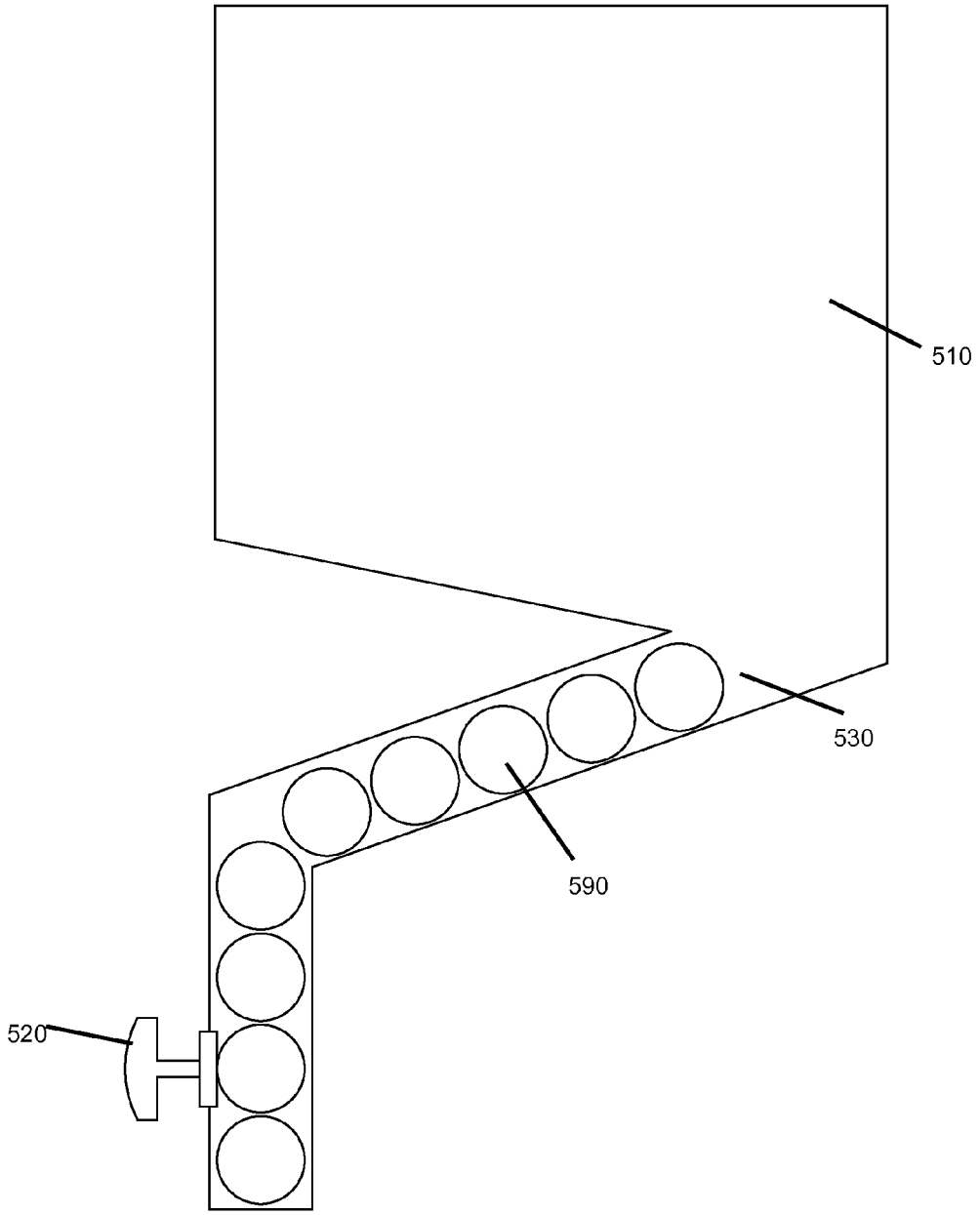
FIG. 5 shows an interior path of pills within a pill bottle in an embodiment of the disclosed technology.

FIG. 5 shows an interior path of pills within a pill bottle in an embodiment of the disclosed technology. The elements here, again, are analogous to those of FIG. 1, except the numbered elements have been incremented by 400. A cavity 510 stores pills within a pill bottle, and the pills exit, via gravity or tilting of the bottle, into an exit tube 530. A plurality of pills 590 is shown with a button 520 which applies pressure on a pill. Pressing the button 520 towards the pill, due to alignment of springs (see FIG. 6) releases pressure on a pill, allowing it to drop.

Figure 6:
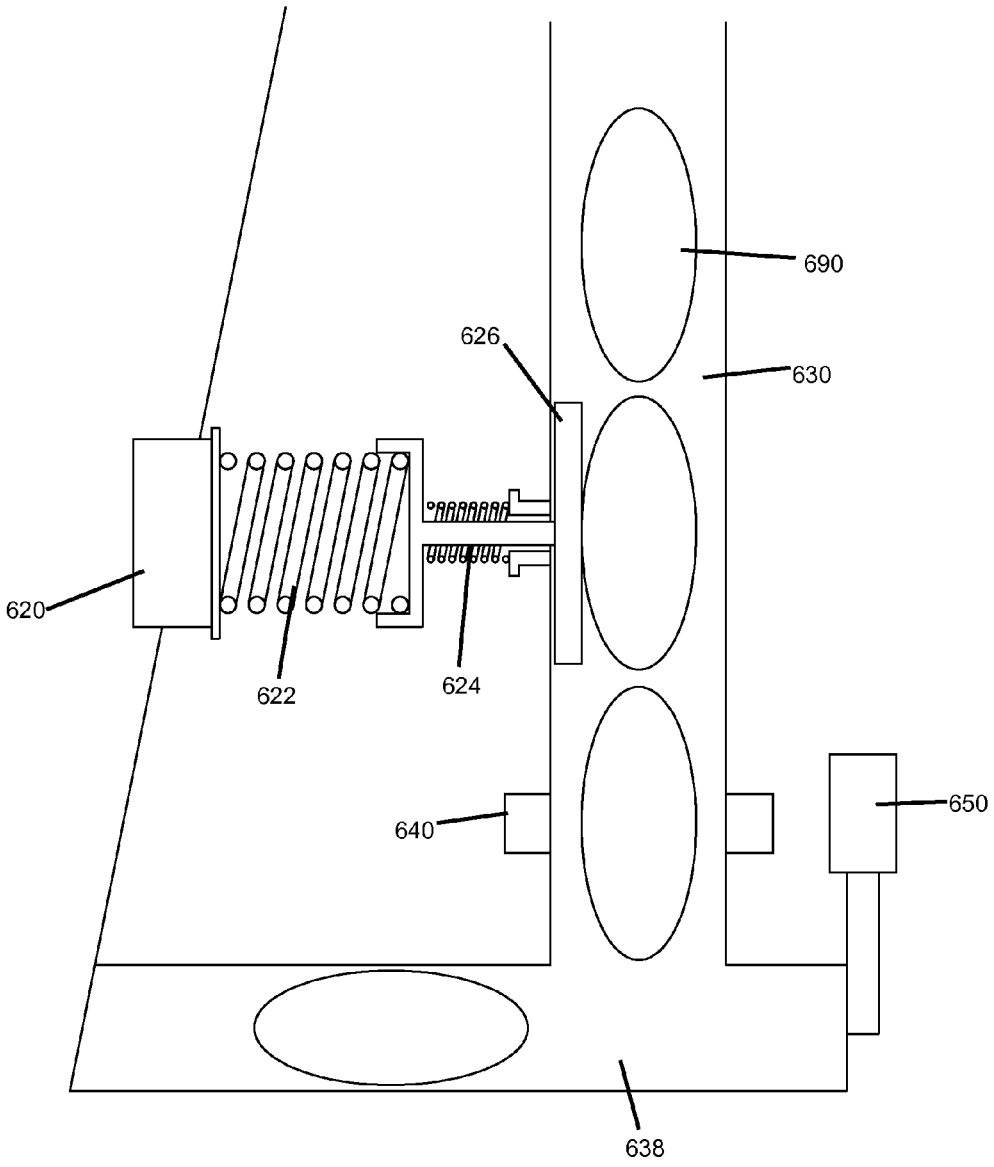
FIG. 6 shows a close-up of a mechanical release mechanism for holding and releasing a pill in an exit chamber in an embodiment of the disclosed technology.

FIG. 6 shows a closeup of a mechanical release mechanism for holding and releasing a pill in an exit chamber, in an embodiment of the disclosed technology. Pills 690, here shown elongated, fall towards the gravitational bottom of the exit tube 630, the gravitational bottom being the bottom of the page, as shown. A button 620 is coupled with a larger, stronger (greater resistance) spring 622 which pushes on a smaller, weaker (less resistance) spring 624. That is, when pushing the button 620 towards the exit tube 630, pressure from the larger spring 522 causes the smaller spring 624 to compress, releasing the grip from the pushing arm 626 on a pill, allowing it to drop. When the blogging bar 640 is open, such as at the appropriate medicine taking time, a released pill is dropped and detected by detector 650, thus closing the blocking bar 640 and/or locking the button 620.

Described in more detail, when the button 620 is first compressed, the smaller spring 624 is initially compressed causing the pill holding button 626 to push against the pill and fix it in place. Then, further pressure on the button 620 causes the larger spring 622 to compress which, in turn, allows the blocking bar 638 to move into position where the hole in the bar is aligned with the opening in the pill chute. This allows any pill below the button 626 to fall out of the chute.

Figure 7:
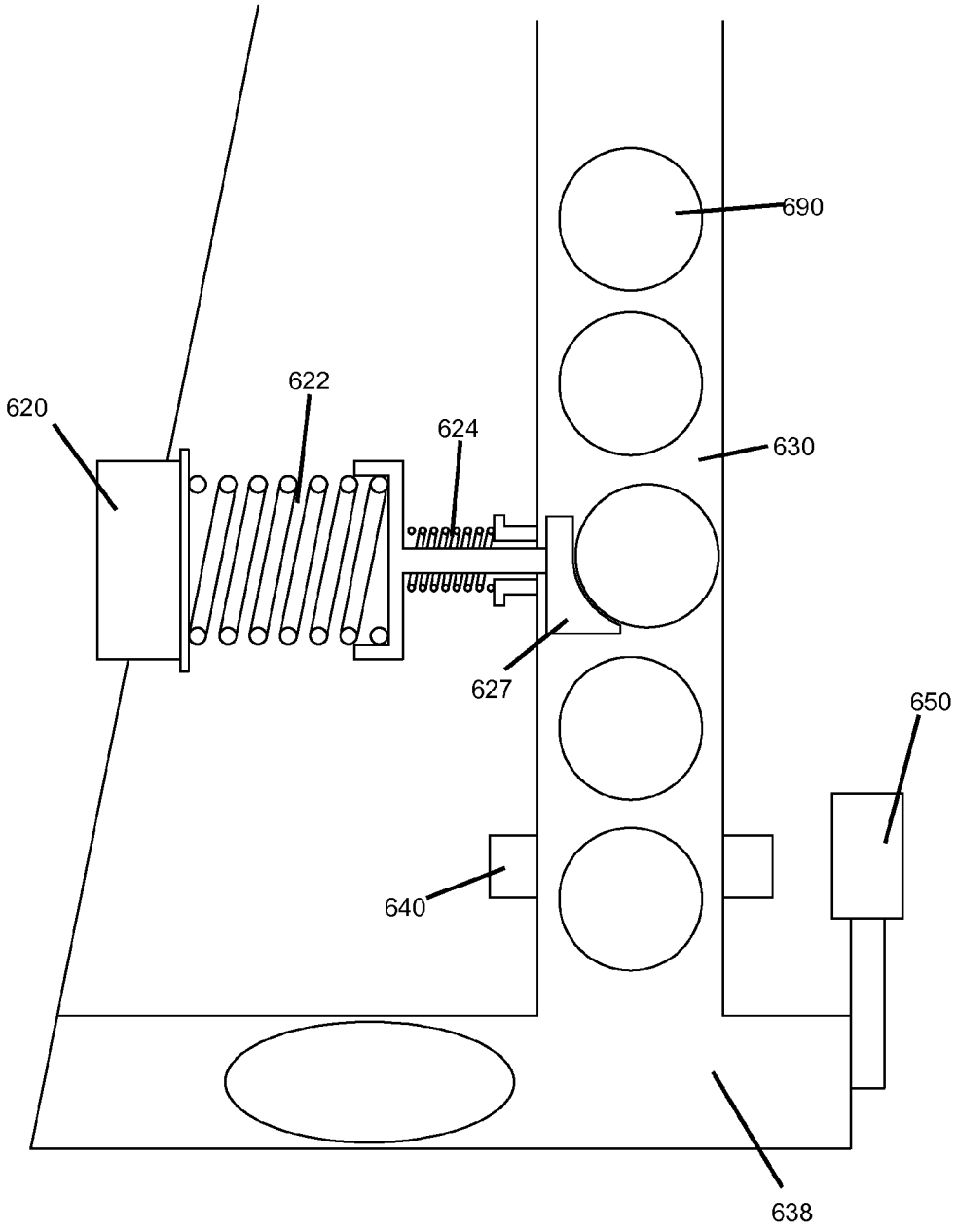
FIG. 7 shows an alternate embodiment of a mechanical release used in embodiments of the disclosed technology.

FIG. 7 shows an alternate embodiment of a mechanical release used in embodiments of the disclosed technology. Here, the pushing arm 627 has a curvilinear side abutting a pill. When detracted, such as by pushing the button 620 against spring 622, the movement triggers an electric current which contracts spring 624, pulling the pushing arm 627 out of the exit tube 630, allowing a pill to drop past the blocking bar 640 (when open) and into the release or exit area 638.

Figure 8:
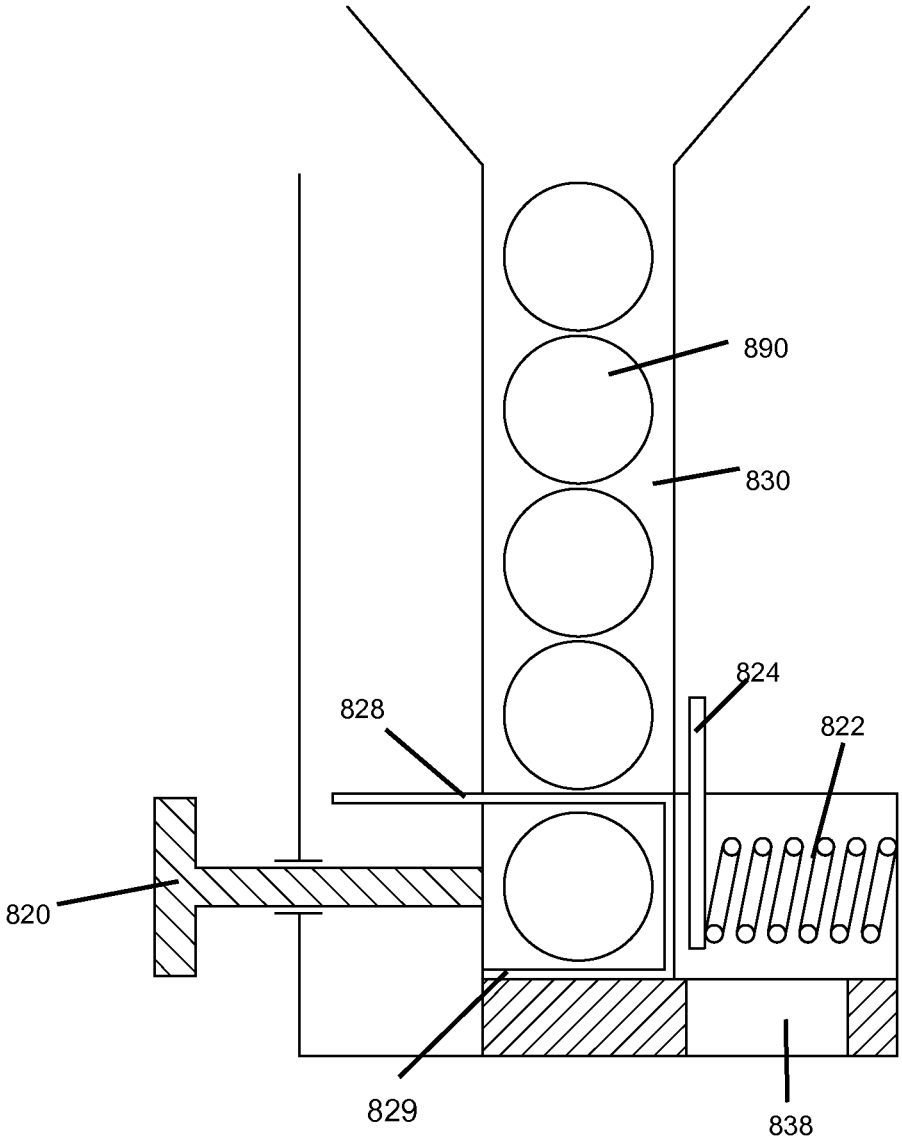
FIG. 8 shows another alternate embodiment of a mechanical release used in embodiments of the disclosed technology.

FIG. 8 shows another alternate embodiment of a mechanical release used in embodiments of the disclosed technology. Here, the pills 890 travel downwards through the exit tube 830 past a blocking bar 828. The blocking bar 828 is part of a housing 829 which has space for a single pill therein. A reverse spring 822 keeps pressure on button 820 and bar 824. The bar 824 is lifted out of the path between the button 820 and spring 822 when medicine can be taken. When the bar 824 is moved upwards or backwards out of the path, then the button 820 is pushable, such that the entire pill housing 829 is moved out of the column of the exit tube 830 and the pill drops into the exit area 838. While the button 820 is pushed to the right, and the pill housing is pushed to the right, the blocking bar 828 prevents another pill from dropping from the exit tube 830 into the housing 829. Once returned to the resting position, as dictated by the spring 822 pushing the housing 829 back into position under the exit tube 830, another pill drops, through a hole in the blocking bar 828 into the housing 829. Simultaneously, or after an allowed dosage of medicine is released, the bar 824 drops back into place mechanically or electrically.

Figure 9:
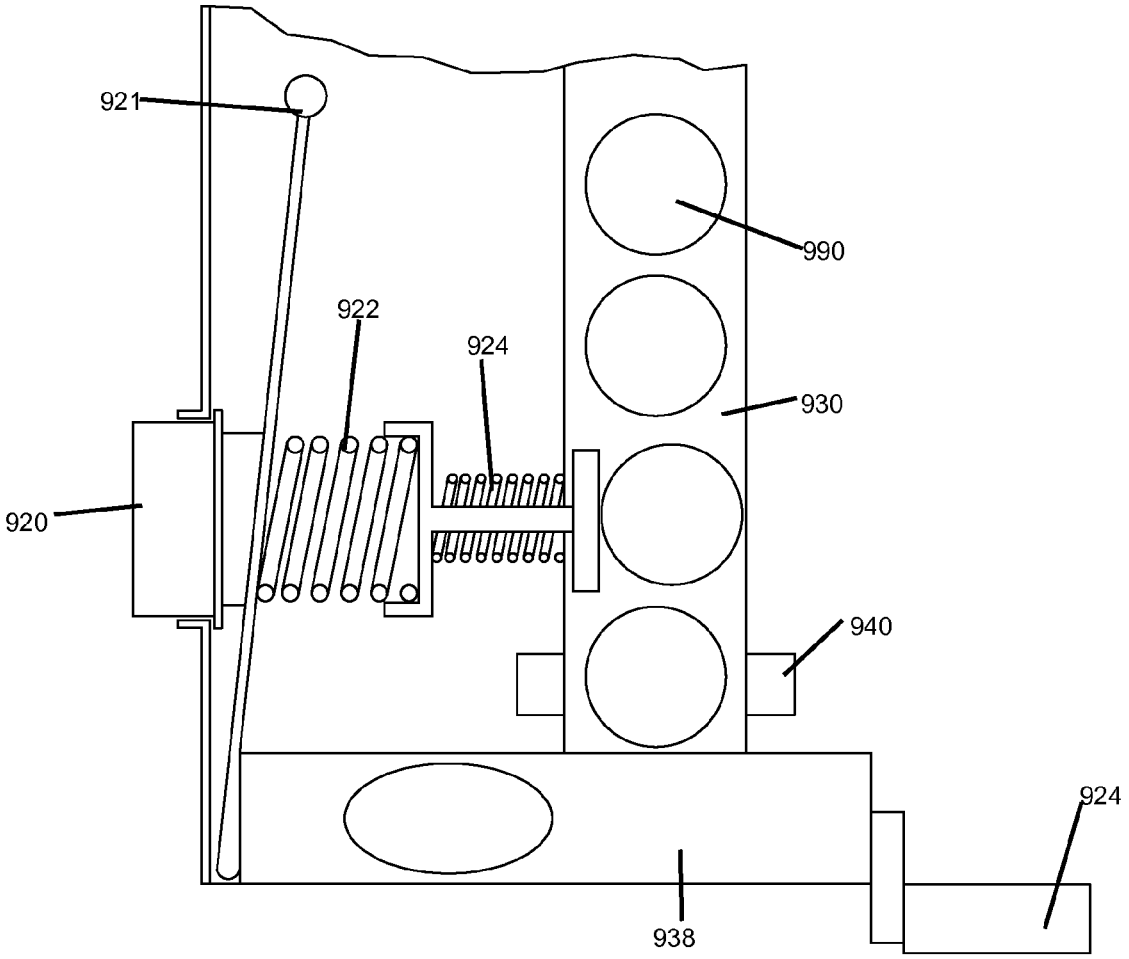
FIG. 9 shows another alternate embodiment of a mechanical release used in embodiments of the disclosed technology.

FIG. 9 shows another alternate embodiment of a mechanical release used in embodiments of the disclosed technology. Here, the elements shown match those of FIG. 1, but are incremented by 800 with the addition of an angle bar 921, which is wedged between a release area 938 and the button/spring 920 and 922. After exiting through the release area 938, the pill may be caught or held above a base 924.

Figure 10:
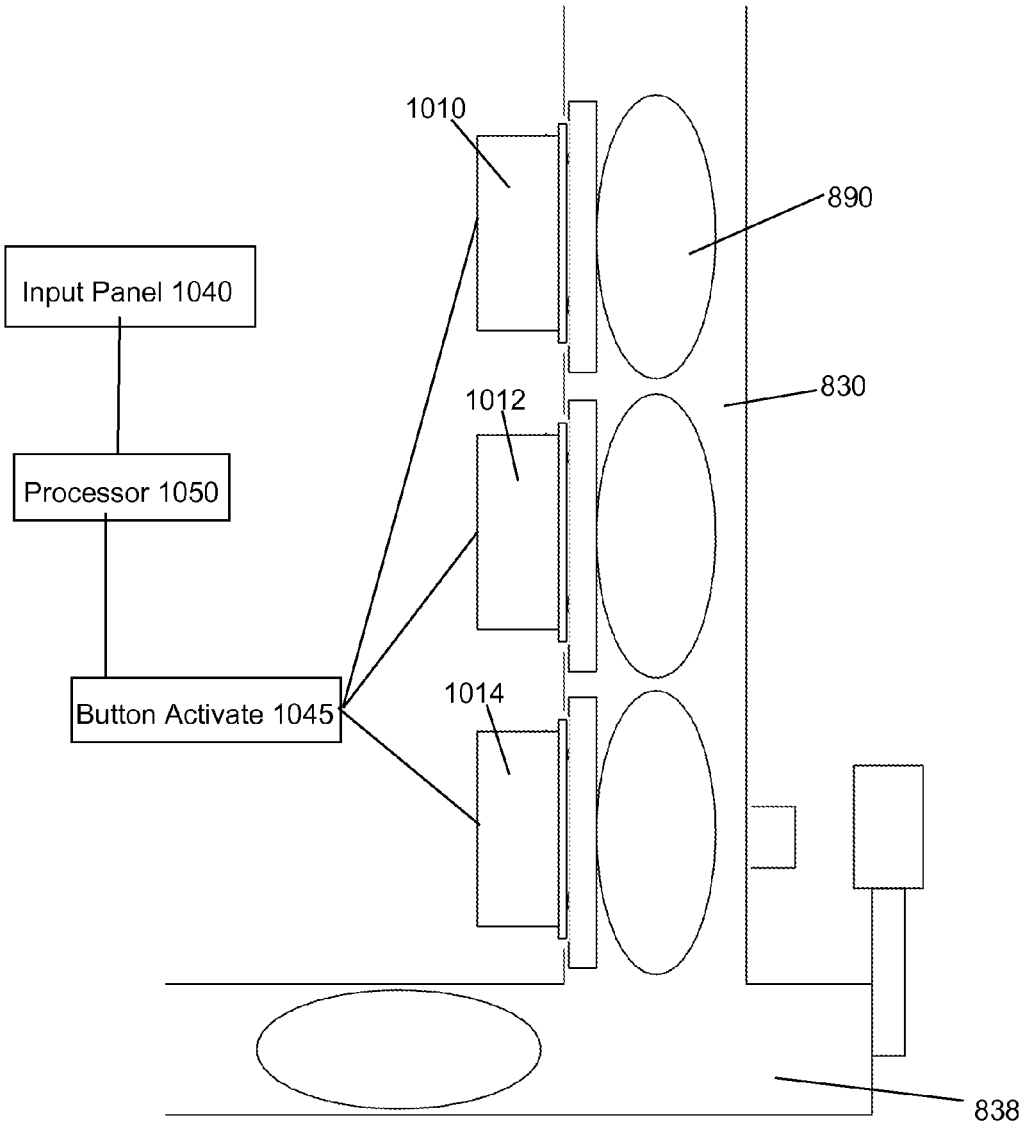
FIG. 10 shows another alternate embodiment using a multiple solenoid release in embodiments of the disclosed technology.

FIG. 10 shows another alternate embodiment using a multiple solenoid release in embodiments of the disclosed technology. Here, there are multiple solenoids 1010, 1012, and 1014 which are, for purposes of the disclosure, buttons activated by way of providing electrical current. Each of these buttons 1010, 1012, and 1014 is configured to hold or release a pill 890 in the chute 830. The buttons activated by a button activating device 1045 configured to activate one or more of the buttons, by way of a processor 1050 instructing the button activate device to act. An input panel 1040 may be used to configure when and how the processor 1050 allows the button activation device 1045 to release a pill. Thus, the button activation device 1045 may open solenoids 1010, 1012, or 1014 in any configuration in order to release one, two, or three pills at a time, in release any number of pills in quick succession at a time to release the pills. In embodiments, only two buttons 1010 and 1012 are needed, allowing, based on when each solenoid is activating, any number of pills to be released. An advantage to three solenoid switched is that two pills can be released with one instruction/electrical charge, while holding a single pill (here, adjacent to button 1010) in place.

Figure 11:
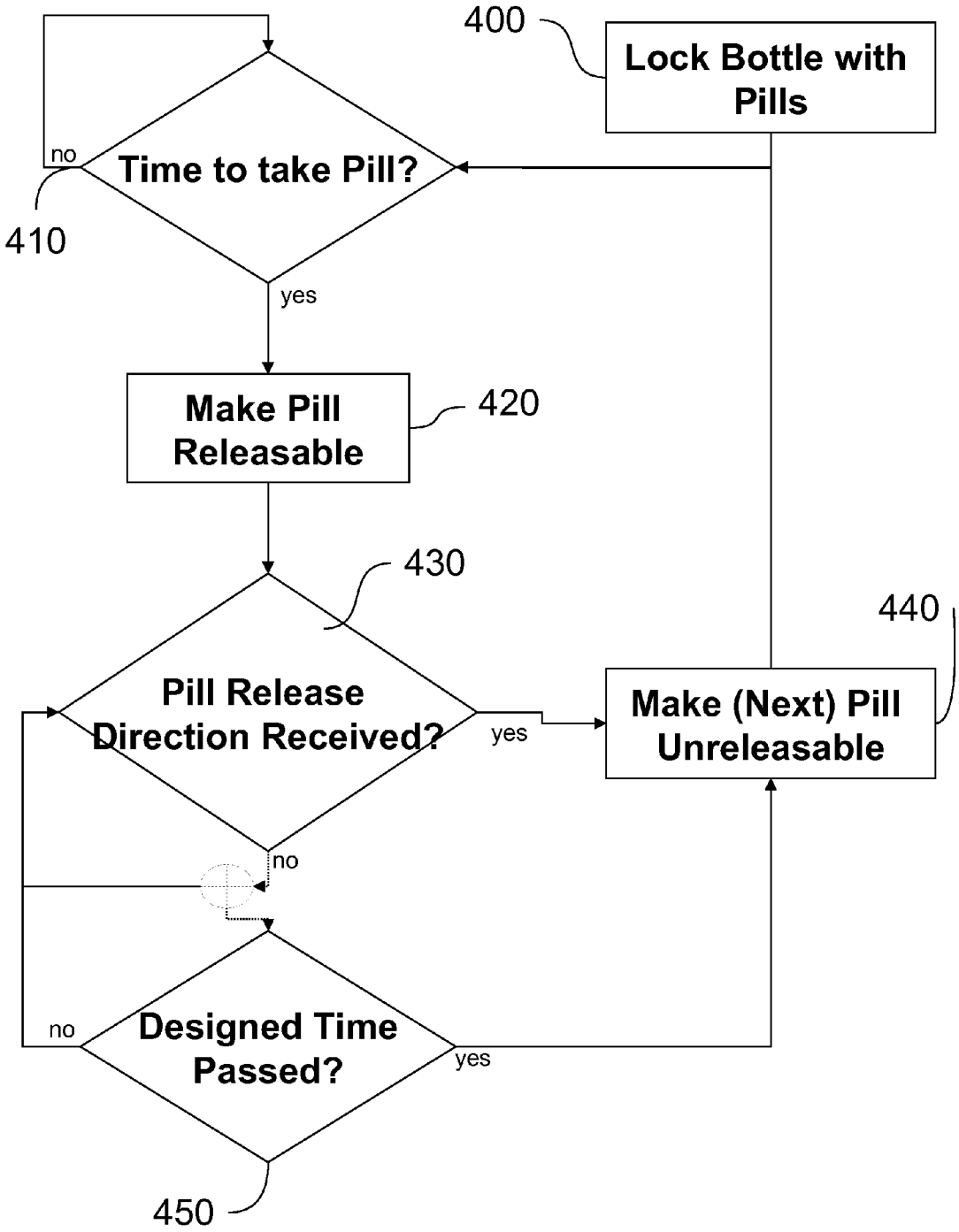
FIG. 11 shows a flowchart of a method of timing pill release using the devices shown in FIGS. 1 through 10, in an embodiment of the disclosed technology.

FIG. 11 shows a flowchart of a method of timing pill release using the devices shown in FIGS. 1 through 10, in an embodiment of the disclosed technology. In a first step 400, a pill bottle, such as those shown and described with reference to FIGS. 1 through 10, is filled with a requisite amount of pills and locked by a pharmacist, doctor, of caregiver. In the course of locking, the bottle is also programmed, such as through a wired or wireless interface with a dedicated bottle programming device or personal computer, or via entry of a programming code using buttons shown in FIG. 2. The bottle is then ready to dispense medication. Based on the program, it is determined in step 410 if it is time to take a pill. If it is not, the step is repeated until the time to take a pill (or pills) has arrived. Once the time arrives, in step 420 the pill is made releasable, and then, in step 430, it is determined if a pill-release instruction is received. A direction to release the pills may be in the form of automated release, partially-automated release, or manual release. Automated release causes the pill to drop into a release area at the designated time. Partially-automated release is a mechanical release of an element within the pill bottle, such as dropping the pill into a release area, moving/rotating a blocking bar, or relieving pressure on a pill) allowing the pill to be released if, and only if a user takes a further action. Manual release takes no mechanical action at the time of arrival of the release, unless a user mechanically acts on the device through a button press or other physical action, or equivalent thereof.

Depending on whether the device is designed or configured in a particular instance for automated, partially-automated, or manual release, once a pill release direction is received, then the next pill or next dose of pills is rendered unreleasable in step 440. This is carried out by moving a blocking bar back into place, locking a mechanical button, or by way of other methods described with reference to the prior figures. If a pill release direction is not received, in step 430 in a manual or semi-manual operating mode, then step 430 is repeated continuously in one embodiment, until the pill is released. However, the pill release may have a designated time limit. In such an embodiment, the clock starts running from the time the pill (or pills) is made releasable in step 420. This is shown in step 450 where it is determined, after the pill is releasable, if a designated amount of time has passed. If no, then steps 430 and 450 repeat until either the pill is released or the designated amount of time for pill release has passed. Once either of these questions is answered in the affirmative, the pill becomes unreleasable until it is time to take the next pill.

Variations, depending on implementation, allow the time frame for future pill releases to be dependent upon the last pill release time, within upper and lower limits. For example, a person may be allowed to take a pill or dosage of medicine no more than once an hour, or no more than four pills in a six hour period. Thus, a first pill will be releasable (step 420) at the zero hour mark. A person may take this pill (when a semi-automated or manual mode is being used) at the 15 minute time interval. The next pill becomes releasable (step 420) at the one hour fifteen minute mark, not the one hour mark. In this manner, using a portable pill bottle, doctors and pharmacists can dose medication without having constant supervision over the patient, thereby allowing the patient to leave, for example, a hospital where such supervision is often used to dose medication, giving a person an ability to take narcotics with much less risk of misuse, or over-dosage, and much more precision than typically afforded for pill dispensing in a hospital setting where nurses must run from patient to patient. This, in effect, gives more control to the patient.

Figure 12:
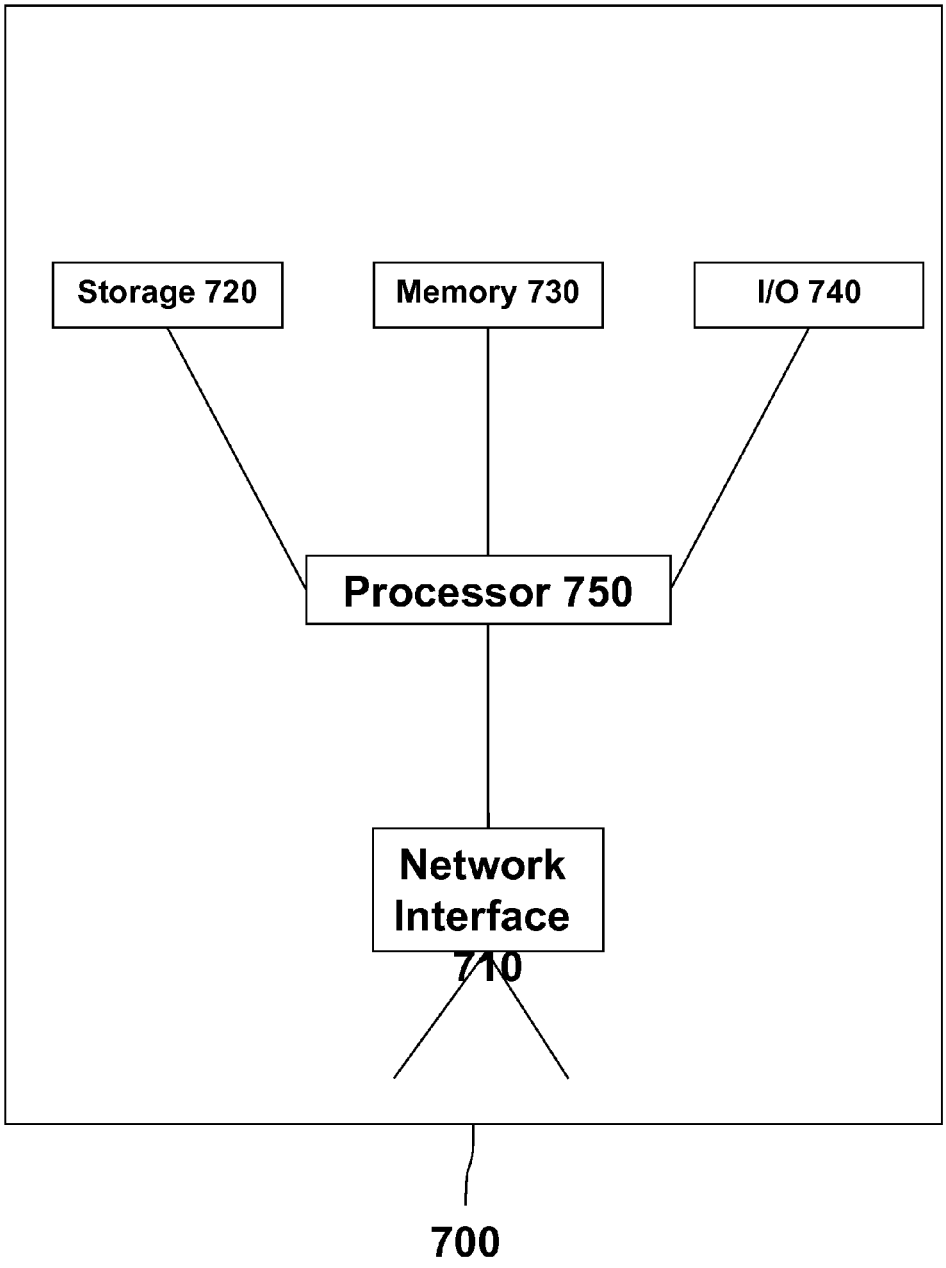
FIG. 12 shows a high-level block diagram of a device that may be used to carry out the disclosed technology.

FIG. 12 shows a high-level block diagram of a device that may be used to carry out the disclosed technology. Device 700 comprises a processor 550 that controls the overall operation of the computer by executing the device's program instructions which define such operation. The device's program instructions may be stored in a storage device 720 (e.g., magnetic disk, database) and loaded into memory 730 when execution of the bottle's program instructions is desired. Thus, the device's operation will be defined by the device's program instructions stored in memory 730 and/or storage 520, and the console will be controlled by processor 750 executing the console's program instructions. A device 700 also includes one or a plurality of input network interfaces for communicating with other devices via a network (e.g., the Internet). The device 700 further includes an electrical input interface. A device 700 also includes one or more output network interfaces 710 for communicating with other devices. Device 700 also includes input/output 740 representing devices which allow for user interaction with a computer (e.g., display, keyboard, mouse, speakers, buttons, etc.). One skilled in the art will recognize that an implementation of an actual device will contain other components as well, and that FIG. 11 is a high level representation of some of the components of such a device for illustrative purposes. It should also be understood by one skilled in the art that the method and devices depicted in FIGS. 1 through 11 may be implemented on a device such as is shown in FIG. 12.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

The invention claimed is:

1. A lockable pill bottle for a plurality of pills, comprising:

a bottom wall, side wall, and top wall with slot for pill entry in any one of said walls, said slot being sealable and lockable;

an inner cavity adapted for pill storage, extending to said slot for pill entry and an exit tube;

said exit tube sized for single-file passage of said plurality of pills;

a spring-loaded member adapted to apply pressure in said exit tube on a single pill of said plurality of pills, such that said pressure prevents exit of said single pill and said single pill blocks other pills of said plurality of pills from exiting; and a solenoid switch button extending through said side wall configured to release said pressure on said single pill when pressed.

2. The lockable pill bottle of claim 1, further comprising a timing device enabling release of a pill of said plurality of pills only at specified times.

3. The lockable pill bottle of claim 2, wherein said timing device enables said release of said pill by removing a blocking bar from an exit tube, said blocking bar situated below said spring-loaded member.

4. The lockable pill bottle of claim 3, wherein said removing of said blocking bar releases a pill of said plurality of pills below said spring-loaded member while said spring-loaded member simultaneously retains another pill of said plurality of pills.

5. The lockable pill bottle of claim 3, wherein said timer enables said release of said pill by causing rotation of a blocking bar, using said button, such that said blocking bar becomes positioned in-line with said exit tube, causing said pill to pass through said blocking bar and said exit tube to a release area.

6. The lockable pill bottle of claim 2, wherein said timer causes release of a pill held beneath said pill held by said pressure of said spring-loaded member at automatic timed intervals.

7. The lockable pill bottle of claim 6, wherein pressing said button causes a pill to be released from said spring-loaded member in a space in said exit tube below said button and above a blocking bar, blocking passage of a pill in said exit tube, lacks a pill therein.

8. The lockable pill bottle of claim 2, wherein, during intervals of time, said timer causes said button to be non-functional.

9. A lockable pill bottle for a plurality of pills, comprising:

a bottom wall, side wall, and top wall with slot for pill entry in any one of said walls, said slot being sealable and lockable;

an inner cavity adapted for pill storage, extending to said slot for pill entry and an exit tube;

said exit tube sized for single-file passage of said plurality of pills;

a spring-loaded member adapted to apply pressure in said exit tube on a single pill of said plurality of pills, such that said pressure prevents exit of said single pill and said single pill blocks other pills of said plurality of pills from exiting; and a button extending through said side wall configured to release said pressure on said single pill when pressed, wherein said spring-loaded member is on an opposite side of a pill housing of said button; and said pill housing comprises an inner space adapted to fit a single pill of said plurality of pills, a top opening adapted to accept a pill into said housing when said housing lacks a pill therein, and a bottom opening adapted to drop a pill into a release area;

such that when said button is pushed in a direction of a said wall of said bottle, said spring-loaded member is compressed, said pill housing moves with said button, a flange blocks entry of a pill of said plurality of pills into said pill housing while said button is being pushed, and a pill in said housing exits to said release area.

10. A method of configuring a pill dispenser, comprising the steps of:

placing pills into an opening which opens into a cavity of a pill bottle, said pill bottle having a lower wall, side walls, and top wall;

closing and locking said opening;

configuring designated time intervals when said pill bottle allows dispensing of pills;

wherein, when said pill bottle allows dispensing of pills, a spring-loaded button is depressable to remove pressure on a pill in an exit tube allowing said pill to drop from said exit tube, said exit tube opening into said cavity and a pill receiving area, said pill receiving area open to an outside of said pill bottle; and wherein pressing said button causes a pill to be released from said spring-loaded button in a space in said exit tube below said button and above a blocking bar, blocking passage of a pill in said exit tube.

11. The method of claim 10, wherein said spring-loaded button is made depressable only at said designated time intervals.

12. The method of claim 10, wherein said spring-loaded member is adapted to apply pressure in said exit tube on a single pill, such that the pressure prevents exit of said single pill and said single pill blocks other pills held in said exit tube from reaching said release area.

* * * * *